US011294412B2

(12) United States Patent
Sorace et al.

(10) Patent No.: US 11,294,412 B2
(45) Date of Patent: Apr. 5, 2022

(54) APPARATUSES AND METHODS INVOLVING SWITCHING BETWEEN DUAL INPUTS OF POWER AMPLIFICATION CIRCUITRY

(71) Applicant: NXP B.V., Eindhoven (NL)

(72) Inventors: Christian Vincent Sorace, Falicon (FR); Ludovic Oddoart, Opio (FR); Fabien Boitard, Mouans Sartoux (FR)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 17/091,401

(22) Filed: Nov. 6, 2020

(65) Prior Publication Data

US 2021/0173422 A1 Jun. 10, 2021

(30) Foreign Application Priority Data

Dec. 4, 2019 (EP) ..... 19306574

(51) Int. Cl.

| | |
|---|---|
| ***G05F 1/575*** | (2006.01) |
| ***G05F 1/445*** | (2006.01) |
| ***G05F 1/46*** | (2006.01) |
| ***G05F 1/565*** | (2006.01) |

(52) U.S. Cl.

CPC ..... *G05F 1/575* (2013.01); *G05F 1/445* (2013.01); *G05F 1/461* (2013.01); *G05F 1/565* (2013.01)

(58) Field of Classification Search

CPC ..... G05F 1/565; G05F 1/575; G05F 1/445; G05F 1/461

See application file for complete search history.

(56) References Cited

U.S. PATENT DOCUMENTS

| | | | | |
|---|---|---|---|---|
| 4,779,037 | A | 10/1988 | Locascio | |
| 6,097,178 | A * | 8/2000 | Owen | G05F 1/575 323/273 |
| 6,198,262 | B1 | 3/2001 | Squibb et al. | |
| 6,621,675 | B2 * | 9/2003 | Ingino, Jr. | G05F 1/575 323/901 |
| 7,253,595 | B2 | 8/2007 | Oddoart et al. | |
| 9,343,963 | B2 | 5/2016 | Cowley et al. | |
| 2010/0060078 | A1 | 3/2010 | Shaw | |
| 2015/0198960 | A1 * | 7/2015 | Zhang | G05F 1/575 323/280 |
| 2016/0306374 | A1 * | 10/2016 | Ghayal | G05F 3/02 |
| 2019/0235551 | A1 | 8/2019 | Pons | |

* cited by examiner

*Primary Examiner* — Kyle J Moody
*Assistant Examiner* — Lakaisha Jackson

(57) ABSTRACT

An example apparatus includes power amplification circuitry and current-level switch circuitry. The power amplification circuitry has a first input port, a second input port, and field-effect transistor (FET) circuitry, the FET circuitry to operate in a saturation mode while drawing power provided at the first input port from a first power source. The current-level switch circuitry is to sense a change in a current-level used to maintain the FET circuitry in the saturation mode and, in response to the sensed change in the current-level, to cause the power amplification circuitry to draw power provided at the second input port from a second power source while maintaining the saturation mode of the FET circuitry.

17 Claims, 7 Drawing Sheets

APPARATUSES AND METHODS INVOLVING SWITCHING BETWEEN DUAL INPUTS OF POWER AMPLIFICATION CIRCUITRY

CROSS-REFERENCE TO RELATED APPLICATIONS

This application claims priority under 35 U.S.C. § 119 to European Patent Application No. 19306574.5, filed on Dec. 4, 2019, the contents of which are incorporated by reference herein.

OVERVIEW

Aspects of various embodiments are directed to switching between dual inputs of power amplification circuitry.

Voltage regulation may be used to provide a well-specified and stable direct current (DC) voltage. An example voltage regulator circuitry includes a low-drop out (LDO) voltage regulator in which the input-to-output voltage difference is typically low. LDO voltage regulators operate based on feeding back an amplified error signal used to control an output current flow of a power transistor that is driving the regulated output voltage. LDO may be used in a variety of applications, such as automotive, portable or mobile devices, and industrial applications.

These and other matters have presented challenges to efficiencies of dual input amplification power circuitry implementations, for a variety of applications.

SUMMARY

Various example embodiments are directed to issues such as those addressed above and/or others which may become apparent from the following disclosure concerning switching between power input sources of amplification power circuitry while maintaining a saturation mode.

In certain example embodiments, aspects of the present disclosure involve monitoring a saturation level of a power device, such as a pass field effect transistor (FET) of a dual input voltage regulator and switching power sources in response to detecting the power device exhibiting a saturation level at the limit of saturation.

In a more specific example embodiment, an apparatus includes power amplification circuitry and current-level switch circuitry. The power amplification circuitry has a first input port, a second input port, and FET circuitry. The FET circuitry is to operate in a saturation mode while drawing power provided at the first input port from a first power source. The current-level switch circuitry senses a change in a current-level used to maintain the FET circuitry in the saturation mode and, in response to the sensed change in the current-level, causes the power amplification circuitry to draw power provided at the second input port from a second power source while maintaining the saturation mode of the FET circuitry. As further described herein, when the FET circuitry operates in the saturation mode, a decrease in an input source voltage (from either the first or second power sources) may not cause a change in a regulated output voltage of the power amplification circuitry. This may be achieved, in some specific embodiments, via the use of two power stages, each power stage coupled to one of the first input port and the second input port. The FET circuitry maintains the saturation mode by switching from the first power stage coupled to the first input port in response to the sensed changed in the current-level (which indicates the power FET of the first power stage is out of saturation or about to be out of saturation) to the second power stage coupled to the second input port. The second power stage, once activated, provides power from the second power source and includes a power FET that is saturated. As such, the FET circuitry, which includes both the first and second power stages, maintains the saturation mode.

The power amplification circuitry may form part of a voltage regulator, such as low drop-out (LDO) voltage regulator. The voltage regulator provides an output signal having a regulated output power supply and/or having a regulated output voltage level. For example, the voltage regulated provides a regulated output voltage to an output port. Load circuitry may be coupled to the output port and is supplied or powered by the regulated output voltage. In some specific embodiments, the first power source includes an external power rail supply and the second power source includes a battery. In such embodiments, wherein during operation, in response to the sensed change in the current-level, the power amplification circuitry begins to draw power from the battery via the second input port. In related and specific embodiments, during operation, in response to the current-level switch circuitry indicating the sensed change in the current-level, the power amplification circuitry switches on-the-fly from drawing power from the first input port to drawing power from the second input port. For example, during operation, in response to the current-level switch circuitry indicating the sensed change in the current-level, the power amplification circuitry is to switch from drawing power from the first input port to drawing power from the second input port, to minimize transient impact on the regulated output voltage level.

The load circuitry may include a secure memory element, a near-field communications (NFC) circuit, and/or other types of circuitry which operate based on the regulated output voltage provided by the power amplification circuitry. In a specific embodiment, the load circuitry includes the secure memory element that includes a circuit to store sensitive data. The secure memory element operates based on a supply voltage connected to, and with integrity of the stored sensitive data being reliant on, the regulated output voltage provided from the FET circuitry of the power amplification circuitry. The regulated output voltage may track with the saturation mode of the FET circuitry being maintained. In other examples, the load circuitry includes an NFC circuit to operate based on the regulated output voltage provided in response to an output from the power amplification circuitry. In such examples, during operation, in response to the current-level switch circuitry indicating the sensed change in the current-level, the power amplification circuitry is to switch on-the-fly from drawing power from the first input port to drawing power from a battery via the second input port without interfering in communications involving the NFC circuit.

The apparatus may further include a feedback path to provide an error-correction signal. As described above, the power amplification circuitry may include a first power stage coupled to the first input port and a second power stage coupled to the second input port, the first and second power stages to provide gate control to the FET circuitry. The apparatus further includes an error amplifier to provide the error-correction signal to the first power stage and the second power stage based on an output signal from the FET circuitry and a reference voltage, and wherein, during operation, the feedback path is used irrespective of whether the power amplification circuitry draws power from the first input port or the second input port. For example, the error amplifier may be shared by both the first and second power stages. In further embodiments, the feedback path provides a feedback signal along a direction from the output signal to another input port of the power amplifier circuitry and wherein, during operation, the feedback path is used irrespective of whether the power amplifier circuitry draws power from the first input port or the second input port. The feedback path may additionally include compensation network circuitry that is shared by the first and second power stages.

The above described apparatus may include additional circuitry and/or variations. For example, the apparatus may include control logic circuitry that operates in an automatic mode and/or manual mode to switch between the power stages and the associated power sources. In some embodiments, the apparatus includes control logic circuitry and mode register. The control logic circuitry may configure the mode register with data to select whether during operation, the power amplification circuitry draws power from the first input port or the second input port. As another example, the apparatus may further include an output port and a capacitor connected to the output port. The output port may provide the regulated output voltage in response to the power amplification circuitry. The capacitor may lessen a magnitude of power spikes at the output port and may provide current to the load circuitry during the transition. In various embodiments, the power amplification circuitry may draw power from both the first and the second input ports in response to the sensed change in the current-level. Other example embodiments are directed to methods of using the apparatuses that include the power amplification circuitry having the first input port, the second input port and the FET circuitry. An example method includes operating the FET circuitry in a saturation mode while drawing power provided at the first input port from a first power source and sensing, via current-level switch circuitry coupled to the FET circuitry, a change in a current-level used to maintain the FET circuitry in the saturation mode. The method further includes, in response, causing the power amplifier circuitry to draw power provided at the second input port from a second power source while maintaining the saturation mode of the FET circuitry. In a number of embodiments, the method further includes causing the power amplification circuitry to switch on-the-fly by switching from drawing power from the first input port to drawing power from the second input port. For example, wherein during operation, in response to the current-level switch circuitry indicating the change in the current-level, drawing, via the power amplifier circuitry, power from a battery via the second input port.

In specific embodiments, the method includes providing gate control to the FET circuitry via a first power stage and a second power stage of the power amplification circuitry, wherein the first power stage is coupled to the first input port, and the second power stage is coupled to the second input port. In such embodiments, causing the power amplifier circuitry to draw power provided at the second input port from the second power source may include switching to the second power stage in response to a decrease in an input source voltage from the first power source such that the decrease in the input source voltage does not cause a reduction in a regulated output voltage provided by the power amplification circuitry. The method may further include providing, via an error amplifier, an error-correction signal to the first power stage and the second power stage based on an output signal from the FET circuitry and a reference voltage.

The above discussion/summary is not intended to describe each embodiment or every implementation of the present disclosure. The figures and detailed description that follow also exemplify various embodiments.

BRIEF DESCRIPTION OF FIGURES

Various example embodiments may be more completely understood in consideration of the following detailed description in connection with the accompanying drawings, in which.

Figure 1:
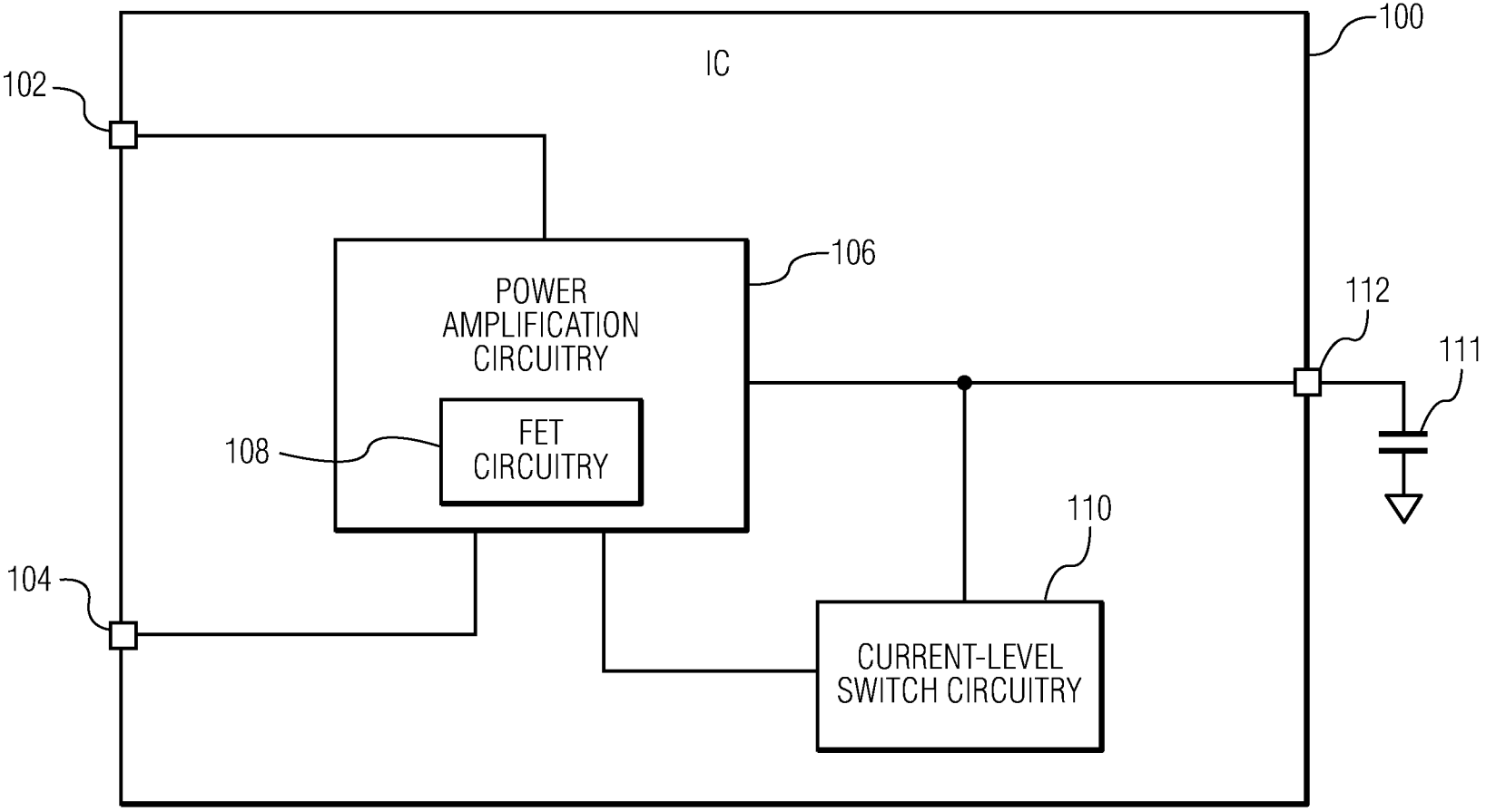
FIG. 1 illustrates an example apparatus, in accordance with various embodiments.

While various embodiments discussed herein are amenable to modifications and alternative forms, aspects thereof have been shown by way of example in the drawings and will be described in detail. It should be understood, however, that the intention is not to limit the disclosure to the embodiments described. On the contrary, the intention is to cover all modifications, equivalents, and alternatives falling within the scope of the disclosure including aspects defined in the claims. In addition, the term "example" as used throughout this application is only by way of illustration, and not limitation.

DETAILED DESCRIPTION

Aspects of the present disclosure are believed to be applicable to a variety of different types of apparatuses, systems and methods involving power amplification circuitry having a first and second input ports coupled to different power sources and field effect transistor (FET) circuitry that maintains a saturation mode while switching from drawing power between the different power sources. In certain implementations, aspects of the present disclosure have been shown to be beneficial when used in the context of a dual input voltage regulator having two different power stages, in which the saturation mode of associated FET circuitry of the power stages is maintained by switching between the power stages. In some embodiments, the FET circuitry maintaining the saturation mode results in a decrease in an input voltage source to the FET circuitry not causing a change in the regulated output voltage of the voltage regulator. While not necessarily so limited, various aspects may be appreciated through the following discussion of non-limiting examples which use exemplary contexts.

Accordingly, in the following description various specific details are set forth to describe specific examples presented herein. It should be apparent to one skilled in the art, however, that one or more other examples and/or variations of these examples may be practiced without all the specific details given below. In other instances, well known features have not been described in detail so as not to obscure the description of the examples herein. For ease of illustration, the same reference numerals may be used in different diagrams to refer to the same elements or additional instances of the same element. Also, although aspects and features may in some cases be described in individual figures, it will be appreciated that features from one figure or embodiment can be combined with features of another figure or embodiment even though the combination is not explicitly shown or explicitly described as a combination. Various circuits may be powered using multiple power sources. A power regulator, such as low drop-out (LDO) voltage regulator may be coupled to the two (or more) power sources and provides a regulated output voltage. The first power source may include an external power rail from an application platform. As the power rail is external, the integrated circuit may be unaware of when power from the first power source may disappear. For example, the external power rail from the application platform may not always be present. When present, the external power rail provides a good dissipation through a power device of the voltage regulator due to the relatively low voltage compared to a second power source, such as 1.2 volts (V). The second power source may include an internal battery supply (VBAT). VBAT may always be present, such as the battery of a mobile phone or smart watch, but may offer worse dissipation through the power device than the first power source compared to the relatively high voltage of the second power source, such as 2.3 to 5 V. Embodiments in accordance with the present disclosure are directed to a dual input voltage regulator that may switch on-the-fly between power sources, such as switching from an external rail to a battery supply. The dual input voltage regulator monitors the region of operation of the power device, sometimes referred to herein as "the power transistor". When the power device is out of saturation (or about to be), the dual input voltage regulator switches to the battery supply. The regulated output voltage is maintained to its voltage level by the voltage regulator in case the external supply disappears. In specific applications, the load supplied by the output of the dual input voltage regulator may continue to operate without seeing or otherwise minimizing transient effects on a supply provided. For example, the voltage regulator switches between the power sources, thereby mitigating the transient effects on the regulated output voltage and/or digital brown out issues, such as when the load circuit may not have enough time to terminate or close on-going tasks correctly prior to completing an operation and which may cause errors. In more specific embodiments, the voltage regulator may include two power stages which output power from one of the respective power sources and which share the same error amplifier and/or compensation network for stability of the output power stages, thereby reducing space used.

In accordance with a number of embodiments, an apparatus includes power amplification circuitry and current-level switch circuitry. The power amplification circuitry has a first input port, a second input port, and FET circuitry. The FET circuitry is to operate in a saturation mode while drawing power provided at the first input port from a first power source. The current-level switch circuitry senses a change in a current-level used to maintain the FET circuitry in the saturation mode and, in response to the sensed change in the current-level, causes the power amplification circuitry to draw power provided at the second input port from a second power source while maintaining the saturation mode of the FET circuitry. When the FET circuitry operates in the saturation mode, a decrease in an input source voltage (from either the first or second power source) does not cause a change in a regulated output voltage of the power amplification circuitry. This may be achieved, in some specific embodiments, via the use of two power stages, each power stage coupled to one of the first input port and the second input port. The FET circuitry may maintain the saturation mode by the switching from the first power stage coupled to the first input port in response to the sensed changed in the current-level, which indicates the power FET of the first power stage is out of saturation or about to be out of saturation, to the second power stage coupled to the second input port. In response to the switch, the second power stage provides power from the second power source and includes a power FET that is saturated. For example, in response to the power FET of the first power stage being out of saturation or out of the saturation range, the voltage regulator switches to the second power stage and the power FET of the second power stage moves to saturation. As such, the FET circuitry, which includes both the first and second power stages, maintains the saturation mode.

The power amplification circuitry may be part of a voltage regulator which provides an output signal having a regulated output power supply and/or having a regulated output voltage level. Load circuitry may be coupled to the output port and is supplied or powered by the regulated output voltage. The load circuitry may include a secure memory element, a near-field communications (NFC) circuit, and/or other types of circuitry which operate based on the regulated output voltage provided by the power amplification circuitry.

The apparatus may further include a feedback path. For example, the apparatus further may include an error amplifier that is shared by the two power stages. The error amplifier may provide the error-correction signal to the first power stage and the second power stage based on an output signal from the FET circuitry and a reference voltage. The feedback path may additionally include compensation network circuitry that is shared by the first and second power stages.

Other example embodiments are directed to methods of using the above-described apparatuses, as further described herein.

Turning now to the figures, FIG. 1 illustrates an example apparatus, in accordance with various embodiments. As shown, the apparatus includes an integrated circuit (IC) 100 having power amplification circuitry 106 used to provide power to a load circuit. The power supply provided may include a regulated output voltage provided to an output port 112 coupled to the load circuitry.

The power amplification circuitry 106 may be part of a voltage regulator that provides a regulated output voltage or voltage level at an output port 112. The power amplification circuitry 106 includes first and second input ports 102, 104 and FET circuitry 108. The power amplification circuitry 106 may be coupled to two power sources via the first input port 102 and the second input port 104. The two power sources may include an external power rail and battery and/or two different external power rails, in various embodiments. The FET circuitry 108, such as a power transistor coupled to the first input port 102, may operate in a saturation mode while drawing power provided from at the first input port 102 from the first power source. As further described herein, the FET circuitry 108 is to operate in the saturation mode when a decrease (or increase) in an input source voltage (from the power source) to the FET circuitry 108 does not cause a change in the regulated output voltage of the power amplification circuitry 106. In specific embodiments, the second power source is a battery. In response to the sensed change in the current-level, the power amplification circuitry 106 begins to draw power from the battery via the second input port 104, as further described herein. The change in the current-level may include a drop or increase in the current-level, in various embodiments.

The voltage regulator may provide the regulated output signal to an output port 112 in response to the power amplification circuitry 106 and a capacitor 111 connected to the output port 112. As described above, the regulated output signal includes a regulated power supply, such as a regulated output voltage provided to the output port 112. The capacitor 111 may lessen magnitude of power spikes at the output port 112. The capacitor 111 may further provide current to the coupled load circuitry during transient.

In various specific embodiments, the power amplification circuitry 106 may form part of a dual input LDO voltage regulator. The voltage regulator may include a first power stage coupled to the first input port 102 and a second power stage coupled the second input port 104. The power stages may sometimes be referred to as "power conversion stages" and/or "output power stages". Each power stage includes FET circuitry including or forming a first stage (e.g., differential pairs of transistors), an intermediate (power) stage, and/or a power transistor, sometimes referred to as a "pass transistor." For more generic information of LDOs and specific information of power stages of an LDO, reference is made to U.S. Pat. No. 7,253,595, entitled "Low Drop-Out Voltage Regulator", filed on May 27, 2003, which is herein incorporated in its entirety for its teaching.

The apparatus further includes current-level switch circuitry 110. The current-level switch circuitry 110 may sense a change in a current-level used to maintain the FET circuitry 108 in the saturation mode. In response to the sensed change in the current-level, the current-level switch circuitry 110 causes the power amplification circuitry 106 to draw power from a second power source, as provided at the second input port 104, while maintaining the saturation mode of the FET circuitry 108 and/or maintaining the regulated output voltage (e.g., regulated output voltage level).

As described above, the power amplification circuitry 106 may include a first power stage coupled to the first input port 102 and a second power stage coupled to the second input port 104, and which respectively provide gate control to the FET circuitry 108. Maintaining the saturation mode of the FET circuitry 108 may include switching from the first power stage to the second power stage, in response to detecting the change in the current-level. The change in the current-level may be indicative of the power transistor of the first power stage being out of saturation and/or at a limitation and/or threshold of being out of saturation, sometimes herein referred to "the saturation range". By switching to the second power stage, which is in saturation, the FET circuitry 108 remains in the saturation mode and the output voltage of the voltage regulator is maintained. For example, in response to the power FET of the first power stage being out of saturation or out of the saturation range, the voltage regulator switches to the second power stage and the power FET of the second power stage moves to saturation. When the FET circuitry 108 (e.g., the power FET of the particular power stage) operates in the saturation mode, a decrease in an input source voltage to the FET circuitry 108 does not cause a change in a regulated output voltage of power amplification circuitry 106.

The apparatus may further include a feedback path to provide a feedback signal along a direction from a regulated output signal (of the FET circuitry 108) to another input port of the power amplification circuitry 106. The feedback signal may include the regulated output voltage, for example. In more specific and related embodiments, as further illustrated herein, the power amplification circuitry 106 further includes an error amplifier. The error amplifier provides an error-correction signal to the first and second power stages based on a comparison of the regulated output signal from the FET circuitry 108 and a reference voltage. The regulated output signal includes the regulated output voltage from the voltage regulator which is used to drive the load circuit. The regulated output signal is feedback along a feedback path to provide the error-correction signal. The feedback path may be used irrespective of whether the power amplification circuitry 106 draws power from the first input port 102 or the second input port 104. Accordingly, in some specific embodiments, the first and second power stages share an error amplifier and/or a compensation network, which provides the same compensation to both the first and second power stages. Although embodiments are not so limited and may include two separate error amplifiers, each associated with one of the power stages and respective feedback paths.

In specific embodiments, during operation, in response to the current-level switch circuitry 110 indicating the sensed change in the current-level, the power amplification circuitry 106 switches on-the-fly from drawing power from the first input port 102 to drawing power from the second input port 104. For example, the power amplification circuitry 106 is to switch from drawing power from the first input port to drawing power from the second input port, to minimize transient impact on the regulated output voltage (e.g., the voltage level of the regulated output signal).

The current-level switching circuitry 110 may include control logic circuitry and a mode register. The control logic circuitry configures the mode register with data to select whether during operation, the power amplification circuitry 106 draws power from the first input port 102 or from the second input port 104. Although embodiments are not so limited, and the control logic circuitry may switch automatically in an automatic mode and/or using the register control in a manual mode, as further described herein.

Although the above describes switching between the first input port 102 and the second input port 104, embodiments are not so limited. For example, in response to the sensed change in the current-level, the power amplification circuitry 106 may draw power from both the second input port 104 and the first input port 102.

The output voltage sometimes herein referred to as "the regulated output voltage", is used to supply a load circuit, such as a near-field communications (NFC) circuit and/or a secure memory element. As previously described, the output voltage is provided to the output port 112 which is coupled the load circuit. In specific examples, the apparatus may further include a secure memory element including a circuit to store sensitive data. The secure memory element operates based on a supply voltage connected to, and with integrity of the stored sensitive data being reliant on, the output voltage provided from the FET circuitry 108. The output voltage tracks with the saturation mode of the FET circuitry 108 being maintained. In response to the sensed change in current-level, the power amplification circuitry 106 is to switch on-the-fly from drawing power from the first input port 102 to drawing power from the second input port 104, such as from a battery via the second input port 104, and without interfering in operations of the secure memory element.

In other specific examples, the apparatus further includes an NFC circuit that operates based on the output voltage (such as a regulated power supply provided in response to the output from the power amplification circuitry 106) as provided at the output port 112. In either example, during operation, in response to the current-level switch circuitry 110 indicating the sensed change in the current-level, the power amplification circuitry 106 is to switch on-the-fly from drawing power from the first input port 102 to drawing power from the second input port 104, such as from a battery via the second input port 104, and without interfering in communications involving the NFC circuit.

Figure 2:
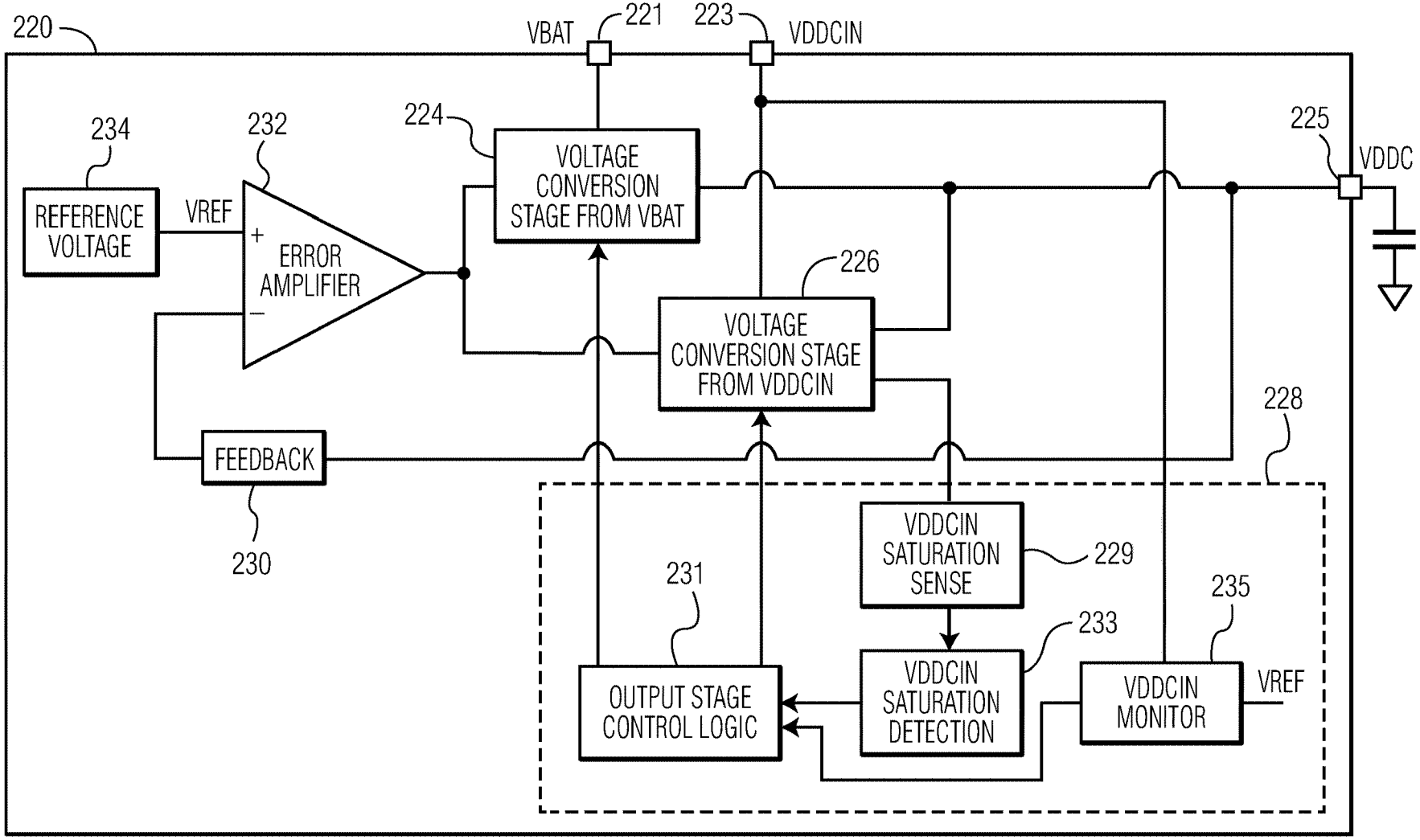
FIG. 2 illustrates another example apparatus, in accordance with the present disclosure.

FIG. 2 illustrates another example apparatus, in accordance with the present disclosure. FIG. 2 illustrates an example IC 220 having a dual input voltage regulator which includes power amplification circuitry having a first input port 223, a second input port 221 and FET circuitry.

As shown and in accordance with various embodiments the power amplification circuitry includes a first power stage 226 and a second power stage 224. The first power stage 226 is coupled to the first input port 223 which is associated with a first power source, e.g., VDDCIN. The second power stage 224 is coupled to the second input port 221 which is associated with a second power source, e.g., VBAT. Each power stage 224, 226 includes FET circuitry including or forming a first stage, an intermediate power stage, and a power FET. The intermediate power stage may provide gate control to the power FET responsive to an error-correction signal from the error amplifier 232.

The power stages 224, 226 may form part of a voltage regulator, such as an LDO voltage regulator, are used to provide a regulated output voltage to the output port 225. The voltage regulator further includes the error amplifier 232 that drives power transistors of the power stages 224, 226. The regulated output voltage is feedback along a feedback path via feedback circuitry 230 and which is input to the error amplifier 232. The feedback circuitry 230 may divide the regulated output voltage and provides the divided regulated output voltage as a feedback signal to the error amplifier 232. For example, the feedback circuitry 230 may include a resistor ladder. The error amplifier 232 compares the regulated output voltage to a reference voltage 234. Current provided by the power transistor of the power stages 224, 226 (depending on which is activated) is controlled according to the comparison of the reference voltage 234 to the feedback signal from the feedback circuitry 230. In specific embodiments, the error amplifier 232 and feedback circuitry 230 is shared by both the first and second power stages 224, 226. Accordingly, the feedback path is used irrespective of whether the power amplification circuitry draws power from the first input port 223 or the second input port 221.

The dual input voltage regulator, illustrated by FIG. 2, may switch between the first and second power sources associated with the first and second input ports 221, 223 via current-level switching circuitry 228. The current-level switch circuitry 228 may include a current-saturation sense circuit 229, a current-saturation detection circuitry 233, control logic circuitry 231 (and which includes a register), and a voltage monitor circuit 235 (e.g., which monitors the input voltage of one or more of the power stages 224, 226). As further described herein, when the power transistor of the first power stage 226 connected to the first input port 223 is in saturation, no current is flowing through the current-level switching circuitry 228. When the power transistor of the first power stage 226 is going out of saturation, current flows through the current-level switching circuitry 228 (e.g., flows through the current-saturation sense circuit 229).

The current-saturation sense circuit 229 may include a FET circuit that is coupled to the power FET of the first power stage 226 and is used to sense the current-level change associated with the first power stage 226 coupled to the first input port 223. The current-saturation detection circuitry 233 may include a current mirror that acts as a current comparator to detect the change in the current-level as sensed by the current-saturation sense circuit 229. The current-saturation detection circuitry 233, in response to the detected change in the current-level, outputs a signal to the control logic circuitry 231 that indicates the detection of the change in the current level (and which is indicative of the first power stage 226 being or about to be out of saturation).

The control logic circuitry 231 provides a control signal to the power stages 224, 226 to select one of (or both, in some embodiments) the power stages 224, 226 based on the signal from the current-saturation detection circuitry 233 and/or a signal from the voltage monitor circuit 235. In specific embodiments, the dual input voltage regulator may switch on-the-fly from VDDCIN external rail to VBAT battery voltage. The current-saturation sense circuit 229 and current-saturation detection circuitry 233 detect whether the first power stage 226 coupled to the VDDCIN external power rail is out of saturation or otherwise exhibits a change in current-level outside a threshold. The voltage monitor circuit 235 detects for the presence of the VDDCIN external power rail. For example, the control logic circuitry 231 switches between the VDDCIN and VBAT based on the output signals of the voltage monitor circuit 235 and/or the current-saturation detection circuitry 233. In specific embodiments, the transition between VDDCIN to VBAT is achieved by or in response to an output signal from the current-saturation detection circuitry 233, and the transition between VBAT to VDDCIN is achieved by or in response to an output signal from the voltage monitor circuit 235. Transitioning between VDDCIN to VBAT by or in response to an output signal from the voltage monitor circuit 235, due to the voltage level, may cause an unwanted or undesirable transient effect on the regulated output, in accordance with various embodiments.

The control logic circuitry 231 may include a mode register, as previously described, that has data to select whether during operation, the power amplifier circuitry draws power from the first input port 223 or from the second input port 221 based on the signal from the current-saturation detection circuitry 233 and/or detection of the presence of a power supply as monitored by the voltage monitor circuit 235. As described above, in various embodiments, the transition between VDDCIN to VBAT is achieved by the current-saturation detection circuitry 233 and the transition between VBAT to VDDCIN is achieved by the voltage monitor circuit 235. For example, the control logic circuitry 231 uses the mode register to determine which of the first and second power stages 224, 226 to activate, and outputs signals to activate or deactivate the first and/or second power stages 224, 226. In other examples, the control logic circuitry 231 automatically switches in an automatic mode by directly providing signals to the first and/or second power stages 224, 226. The signal may be provided to an intermediate power stage of each of the first and second power stages 224, 226 which are coupled between the error amplifier 232 and a gate of the respective power transistor (e.g., FETs) of the power stage 224, 226. The intermediate power stages provide gate control to the power transistors and which may be controlled by a signal input thereto by the control logic circuitry 231 and the error-correction signal from the error amplifier 232.

The first and second power stages 224, 226 of the dual input voltage regulator may share a number of circuit components. For example, the first and second power stages 224, 226 share the error amplifier 232, the feedback path/circuitry 230, and/or compensation network circuitry (as further illustrated by FIG. 3). By sharing components, the size of the voltage regulator may be reduced. Furthermore, the two power stages 224, 226 may use the same compensation via the shared error amplifier 232. In some embodiments, the regulator output performance may be similar and/or the same for both power stages 224, 226.

Figure 3:
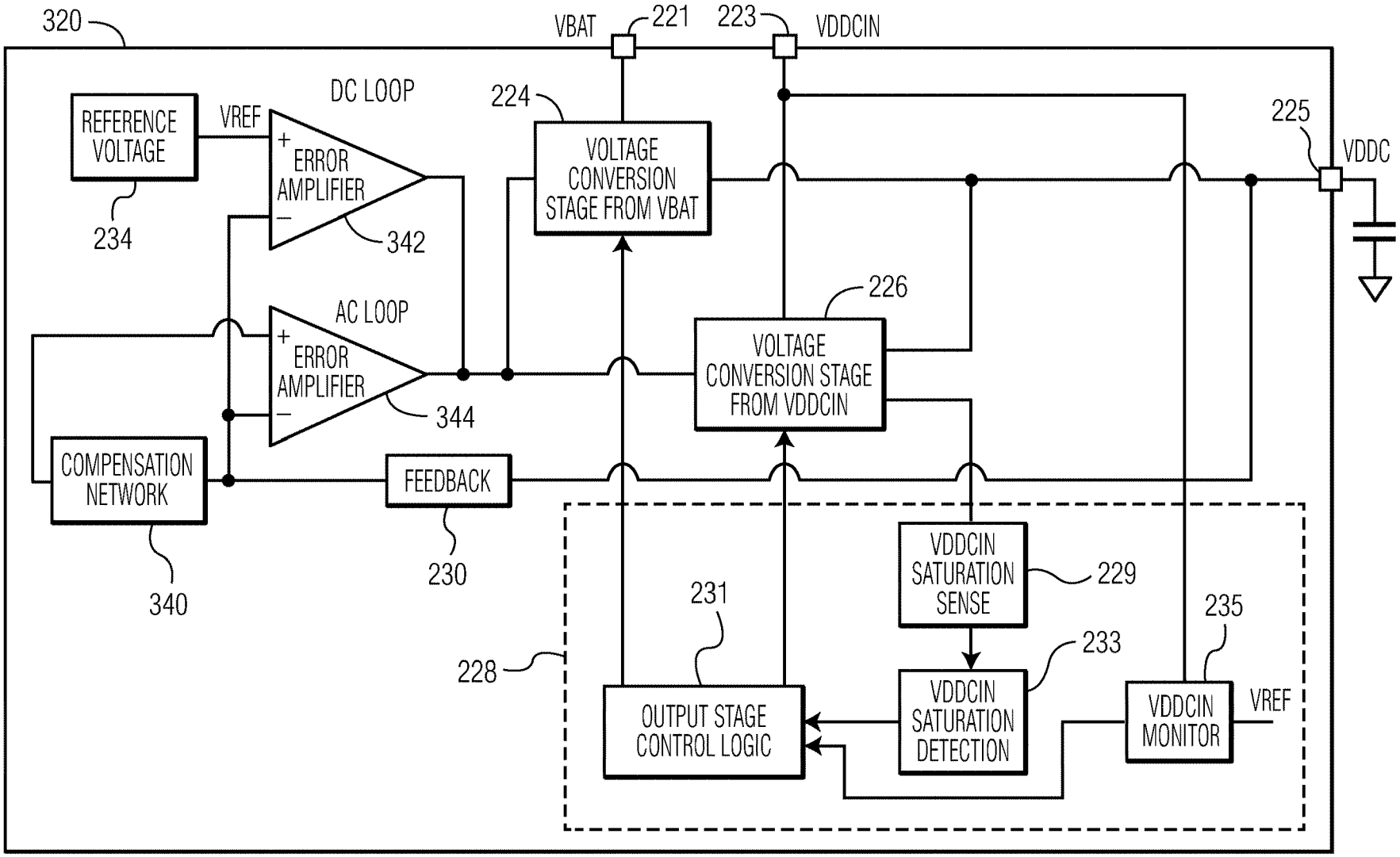
FIG. 3 illustrates another example apparatus, in accordance with the present disclosure.

FIG. 3 illustrates another example apparatus, in accordance with the present disclosure. The IC 320 of FIG. 2 includes the dual input voltage regulator including the first and second power stages 224, 226 which are coupled to the first and second input ports 221, 223 and provide a regulated output voltage to an output port 225, as previously described in connection with FIG. 2. Similar to FIG. 2, the dual input voltage regulator may switch between the two power sources via the current-level switch circuitry 228.

Similar to FIG. 2, the voltage regulator includes feedback circuitry 230 for providing a feedback signal along a feedback path based on the regulated output voltage. As shown, compensation network circuitry 340 is within the feedback path, and is shared between the two output power stages 224, 226 and shared for both a direct current (DC) loop and an alternating current (AC) loop. The compensation network circuitry 340 may include FET circuitry, a capacitor, and/or resister. The voltage regulator may include a first error amplifier 342 and a second error amplifier 344. The first error amplifier 342 is associated with the DC loop which is used to maintain the regulated output voltage level and other DC parameters. The first error amplifier 342 compares the regulated output voltage (e.g., the feedback signal) to the reference voltage 234, and provides an error-correction signal based on the comparison. The second error amplifier 344 is associated with the AC loop which is used to adjust a frequency response of the voltage regulator. For more general and specific information on DC and AC feedback loops and compensation network circuitry, reference is made to U.S. Pat. No. 7,253,595, entitled "Low Drop-Out Voltage Regulator", filed on May 27, 2003, which is herein incorporated in its entirety for its teaching.

Figure 4A:
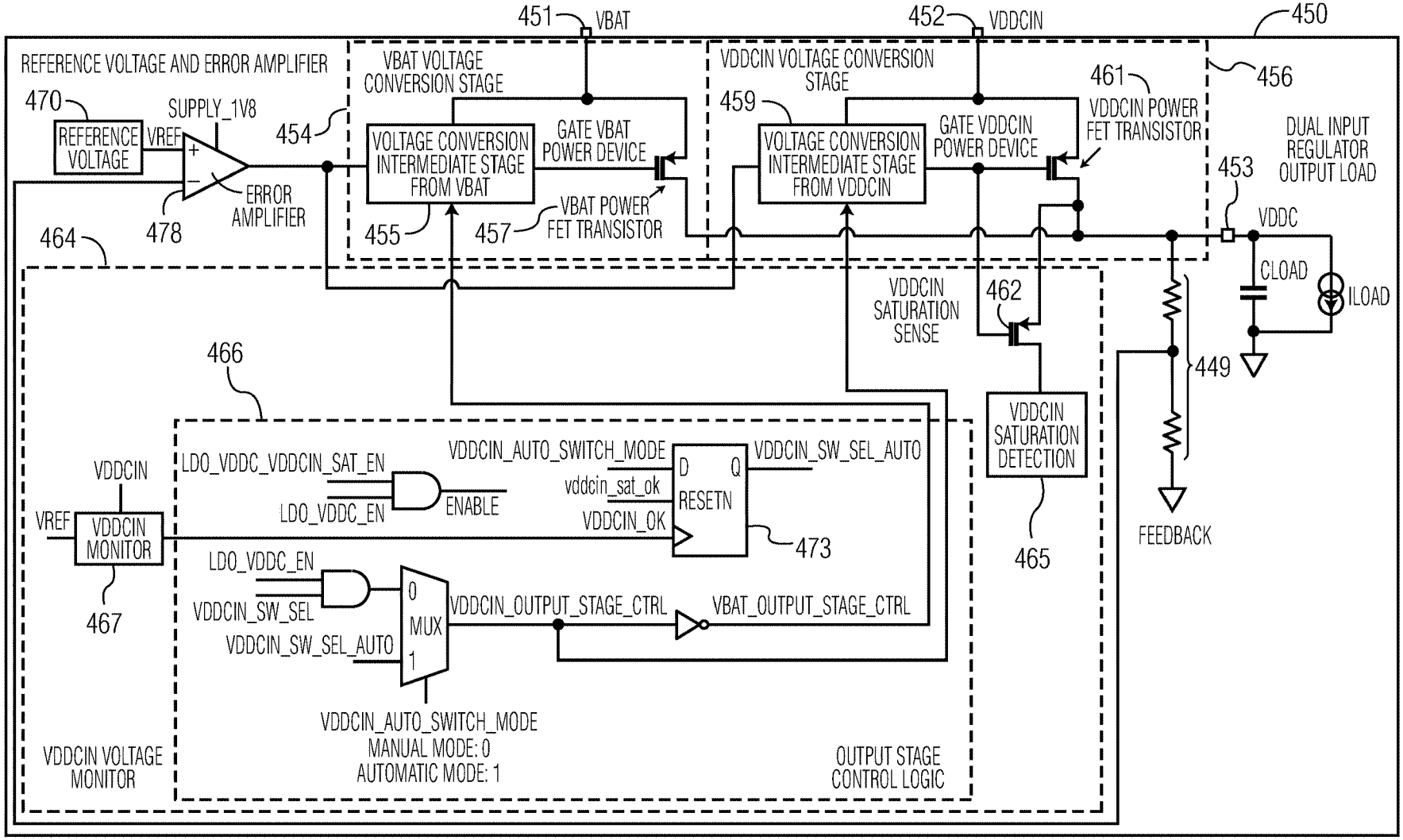
FIGS. 4A-4C illustrate example circuitry of an apparatus, in accordance with the present disclosure.
Figure 4B:
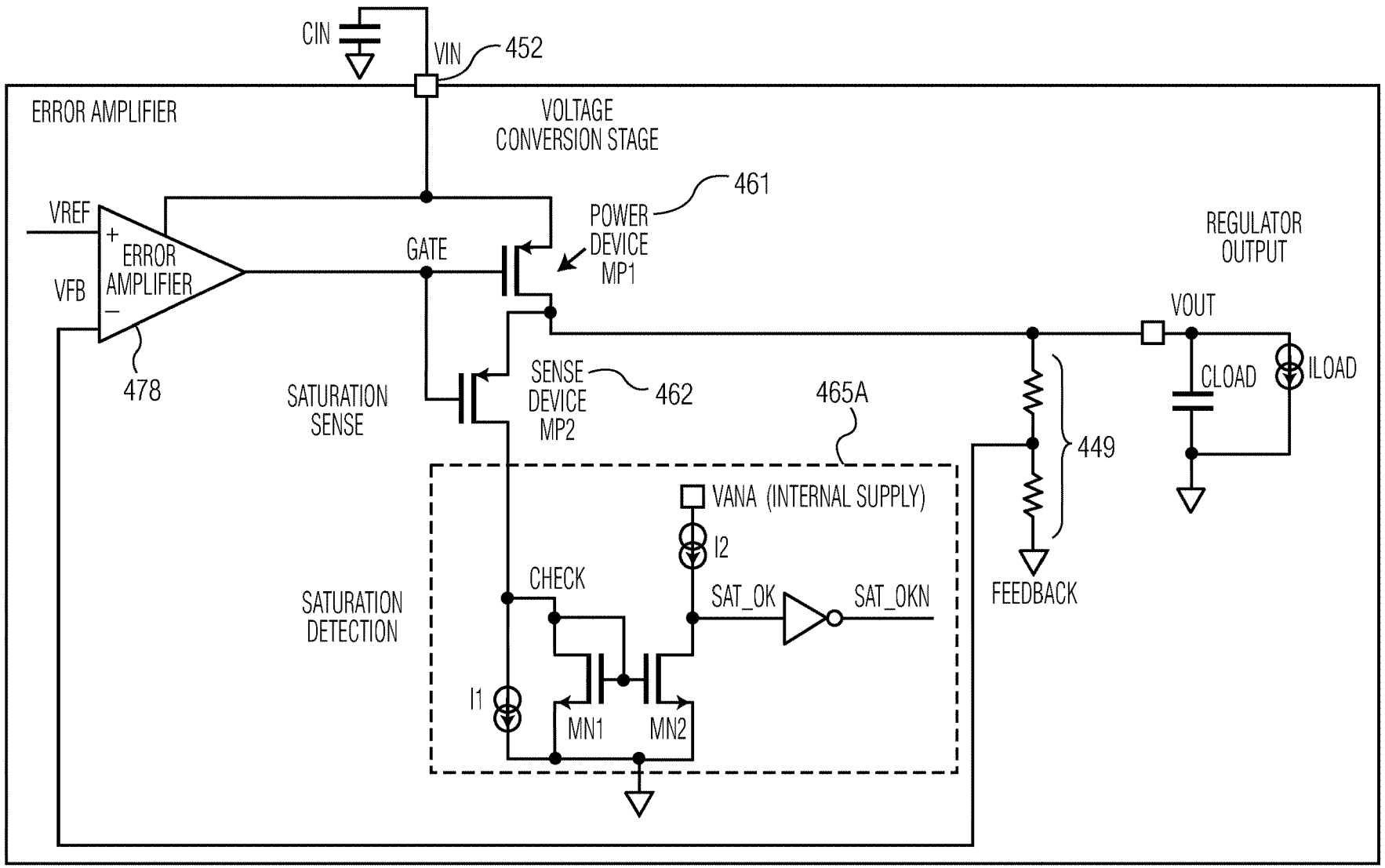
Figure 4C:
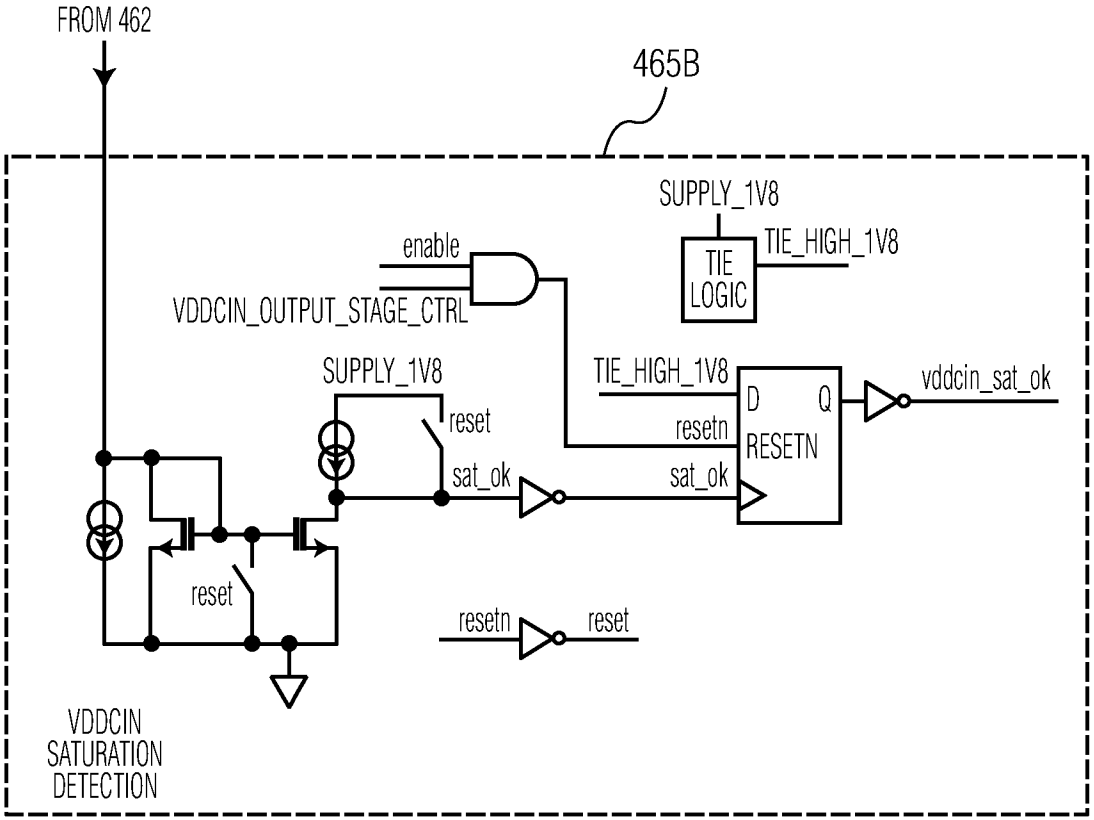

FIGS. 4A-4C illustrate example circuitry of an apparatus, in accordance with the present disclosure. Similar to FIGS. 2-3, the apparatus 450 illustrated by FIGS. 4A-4C includes power amplification circuitry coupled to a first input port 452 and a second input port 451 and including FET circuitry to provide a regulated output voltage at the output port 453. The power amplification circuitry includes a first power stage 456 coupled to the first input port 452 used to provide power from a first power source, e.g., VDDCIN. The power amplification circuitry further includes a second power stage 454 coupled to the second input port 451 used to provide power from a second power source, e.g., VBAT. Each power stage 454, 456 includes at least an intermediate power stage 455, 459 and a power FET 457, 461.

The power stages 454, 456 form part of a voltage regulator coupled to the two power sources and which provides a regulated output voltage at an output port 453. The voltage regulator includes a feedback path including the feedback circuitry (e.g., resistors 449 coupled to the regulated output voltage) that provides a feedback signal indicative of the output voltage to an error amplifier 478. The error amplifier 478 compares the feedback signal to a reference voltage 470 and provides an error-correction signal to the intermediate power stages 455, 459 which drive the gate voltage of the power FETs 457, 461. The intermediate power stages may be activated by the current-level switching circuitry 464.

As previously described with respect to FIG. 2, the current-level switching circuitry 464 is used to switch between power sources, which may occur on-the-fly. The current-level switching circuitry 464 may include a current-saturation sense circuit 462, a current-saturation detection circuitry 465, control logic circuitry 466 (and which includes a register), and a voltage monitor circuit 467.

Figure 5:
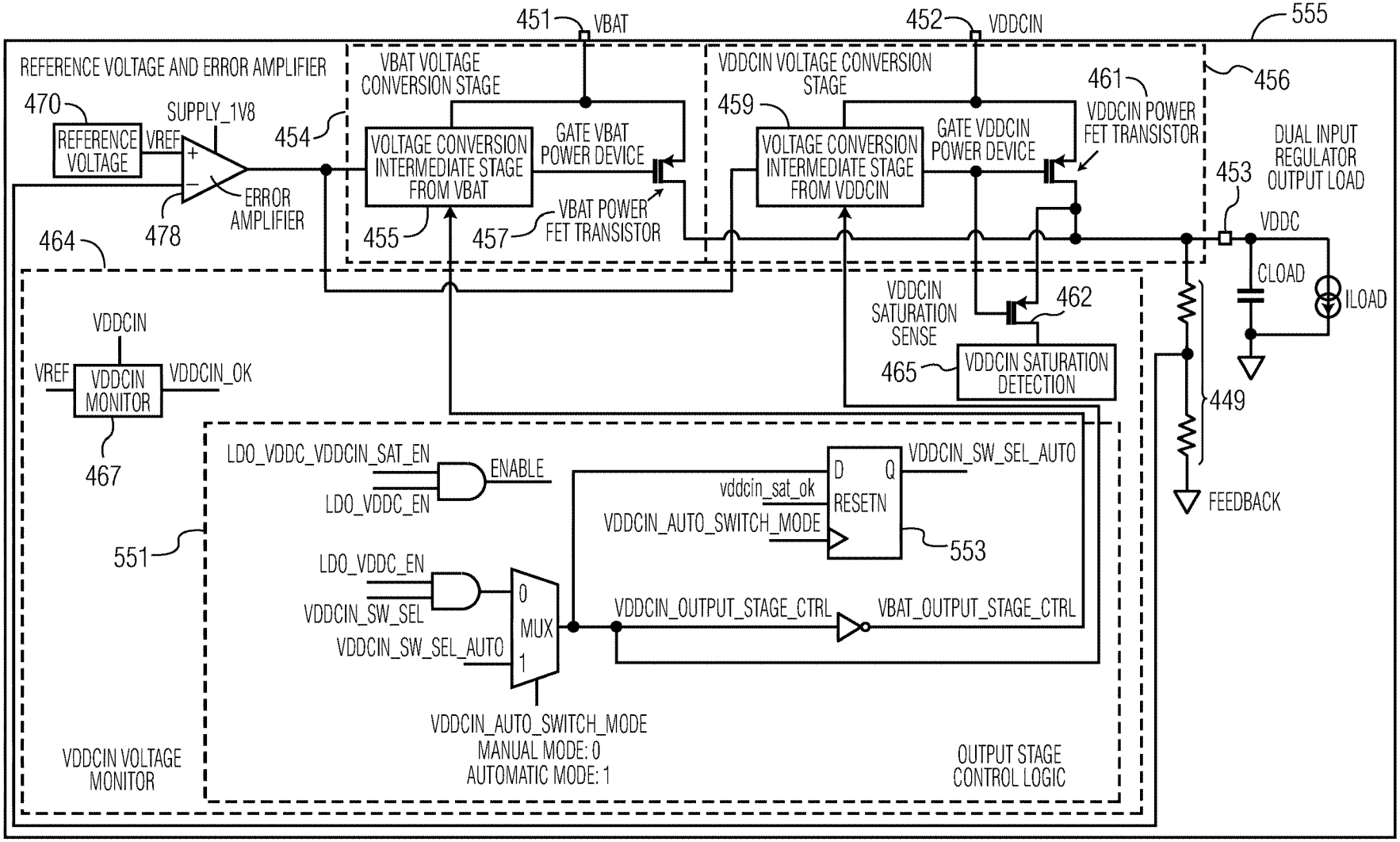
FIG. 5 illustrates another specific example apparatus, in accordance with the present disclosure.

The following provides example signals used in FIGS. 4A-5:

VDDCIN_AUTO_SWITCH_MODE:
- 0: manual mode with control from register
- 1: switching on the fly activated VBAT_OUTPUT_STAGE_CTRL:
- 0: VBAT output stage not selected
- 1: VBAT output stage selected VDDCIN_OUTPUT_STAGE_CTRL:
- 0: VDDCIN output stage not selected
- 1: VDDCIN output stage selected sat_ok (analog signal):
- 0: VDDCIN power device not in saturation
- 1: VDDCIN power device in saturation vddcin_sat_ok digital signal:
- 0: VDDCIN power device not in saturation
- 1: VDDCIN power device in saturation VDDCIN_SW_SEL: select output stage in manual mode from register
- 0: VBAT output stage selected
- 1: VDDCIN output stage selected VDDCIN_SW_SEL_AUTO: select output stage in automatic mode from register
- 0: VBAT output stage selected
- 1: VDDCIN output stage selected LDO_VDDC_EN: regulator enable LDO_VDDC_VDDCIN_SAT_EN: enable VDDCIN power device saturation monitoring.

FIG. 4B illustrates a close up view of an example current-saturation sense circuit 462 and current-saturation detection circuitry 465A of the current-level switching circuitry 464. The current-saturation sense circuit 462 may include a FET circuit MP2 that is coupled to the power FET 461, e.g., MP1, of the first power stage 456 and is used to sense the current-level change associated with the first power stage 456 coupled to the first input port 452. The current-saturation sense circuit 462 may detect that MP1 is out of the saturation region, which is detected according to voltage, process, and temperature variation of the MP. Additionally, the current-saturation sense circuit 462 may allow for accurate input voltage drop detection and allow for overcurrent detection. FIG. 4C illustrates a close up view of another example current-saturation detection circuitry 465B, which may include the current-saturation sensor circuit 462 in some embodiments. The example current-saturation detection circuitry 465, 465A, 465B illustrated by FIGS. 4A-4C are herein generally referred to as "current-saturation detection circuitry 465" for ease of reference.

The current-saturation detection circuitry 465 may sense gate and drain voltages of MP1 to check if MP1 is in saturation region using the MP2 sense transistor. As previously described, the current-saturation detection circuitry 465 includes a current mirror that acts as a current comparator to detect the change in the current-level as sensed by the current-saturation sense circuit 462.

The current-saturation detection circuitry 465, in response to the detected change in the current-level, outputs a signal (e.g., SAT_OK at a low level) to the control logic circuitry 466 that indicates the detection of the change in the current level. The output signal may be indicative of the first power stage 456 being or about to be out of saturation.

More specifically, MP2 and MP1 may share the same gate voltage and the source of MP2 is connected on the drain of MP1. If MP1 is in the saturation region/mode, then MP2 senses the device is off. When MP1 is in the saturation mode, no current is flowing through MP2 and a signal SAT_OK (at high level) may be provided by the current-saturation detection circuitry 465 indicating that MP1 is in the saturation region. As soon as MP1 is out of saturation region, then MP2 moves to the saturation region. A current is flowing through MP2 and a signal SAT_OK (at low level) may be provided by the current-saturation detection circuitry 465 indicating that MP1 is out of the saturation region.

The sensing of the current-level change may be based on sensing gate and drain voltage of MP1 using MP2 and the current-saturation detection circuitry 465. The current-saturation detection circuitry 465 may include a current mirror (e.g., MN1 and MN2), a current sink and current source I1, I2, and an inverter. MP2 may be associated with the current sink I1. The current sink I1 acts as a pull down and the current source 12 acts as a pull up. MP2 and MP1 share the same gate voltage, and the source of MP2 is connected to the drain of MP1. MP1 may be sized according to the specified max load current and is kept in the saturation region on the whole output load current range for normal operation.

The control logic circuitry 466 responds to the signal output by the current-saturation detection circuitry 465 and/or a signal from the voltage monitor circuit 467 indicating whether or not VDDCIN is present by providing a control signal to the first and second power stages 454, 456. FIG. 4A illustrates an example of the control logic circuitry 466 operating in an automatic mode, in which the power stages are automatically selected. In the automatic mode, the transition of the power stages from the second power stage 454 (e.g., VBAT) to the first power stage 456 (e.g., VDDCIN) is achieved by the signal from the voltage monitor circuit 467. Once the VDDCIN supply is above a threshold (e.g., high enough), the voltage regulator is set under the first power stage 456. The transition of the output stage from the first power stage 456 to the second power stage 454 is achieved by the signal from the current-saturation detection circuitry 465.

In specific embodiments, the control logic circuitry 466 includes output stage control logic 473. As described above, in the automatic mode, the latch of the output stage control logic 473 is set to detect the transition from VBAT to VDDCIN via the voltage monitor circuit 467 and to detect the transition from VDDCIN to VBAT via the current-saturation detection circuitry 465. The transition from VBAT to VDDCIN may be managed by the VDDCTN_OK signal from the voltage monitor circuit 467. If VDDCIN_OK is detected, the voltage regulator moves to the (VDDCIN) first power stage 456. VDDCIN_AUTO_SWITCH_MODE from the register is connected as an input of the D latch.

The following provides example equations for desaturation and saturation of MP1 through MP2. The saturation region of MP1, in the case of normal LDO operation is:

$$Vds1>Vgs1-Vth1 \rightarrow Vgs1-Vds1<Vth1 \quad \text{(Eq. 1)},$$

where Vds1 is the drain voltage of MP1, Vgs1 is the gate voltage of MP1, and Vth1 is the threshold voltage (e.g., gate voltage when current flows between the source and drain) of MP1. From MP2 connection, the following equation (2) is deduced:

$$Vgs1=Vgs2+Vds1 \rightarrow Vgs2=Vgs1-Vds1 \quad \text{(Eq. 2)},$$

where Vgs2 is the gate voltage of MP2. Finally, equation (Eq. 3) is deduced from (Eq. 1) and (Eq. 2):

$$\rightarrow +Vgs2<Vth1 \quad \text{(Eq. 3)}$$

As MP1 and MP2 are same type of transistor, MP1 and MP2 have the same Vth. When MP1 is in the saturation mode or region, MP2 does not flow current (as Vgs2<Vth1). Additionally, the CHECK node is pulled down by II and SAT_OK node is pulled up, meaning that MP1 is in the saturation region.

MP1 may be at the limit of the saturation region in the case that:

Eq. 1 is Vds1=Vgs1−Vth1 → Vgs1−Vds1=Vth1

Eq. 2 is Vgs1=Vgs2 → Vds1+Vgs2=Vgs1−Vds1

Eq. 3 is Vgs2=Vth1.

MP1 may be out of the saturation region in the case that:

Eq. 1 is Vds1<Vgs1−Vth1 → Vth1<Vgs1−Vds1

Eq. 2 is Vgs1=Vgs2 → Vds1+Vgs2=Vgs1−Vds1

Eq. 3 is then Vth1<Vgs2.

In case of MP1 being at limit of saturation or out of saturation, MP2 flows current as Vds2>Vgs2 −Vth1>0. The CHECK node is pulled up and SAT_OK node is pulled down, meaning that MP1 is out of saturation region. MN1 and MN2 may be sized to amplify the current difference between MP2 and I1.

FIG. 5 illustrates another specific example apparatus, in accordance with the present disclosure. More specifically, FIG. 5 illustrates an apparatus 555 which has a dual input voltage regulator. The dual input voltage regulator includes the first and second power stages 454, 456 which are coupled to the first and second input ports 451, 452 and provide a regulated output voltage to an output port 453, as previously described in connection with FIG. 4A. Similar to FIG. 4A, the dual input voltage regulator may switch between the two power sources, VBAT and VDDCIN, via the current-level switch circuitry 464. The current-saturation detection circuitry 465 of the apparatus 555 of FIG. 5 may include the circuitry previously described in the close up views illustrated by FIG. 4B and/or FIG. 4C (e.g., the current-saturation detection circuitry 465A and/or 465B).

The control logic circuitry 551 of FIG. 5 illustrates an example in which the control logic circuitry 551 may switch between the power sources in either or both of an automatic mode or a manual mode. The manual mode may be used to switch from the second power stage 454 to the first power stage 456 and the automatic mode may be used to switch from the first power stage 456 to the second power stage 454. The transition from the second power stage 454 associated with VBAT to the first power stage 456 associated with VDDCIN may be achieved by register control in the manual mode. For example, the register control may be achieved through VDDCIN_AUTO_SWITCH_MODE=0 and VDDCIN_SW_SEL registers. VDDCIN_SW_SEL register may be set from 0 to 1 to move from the second power stage 454 (e.g., VBAT) to the first power stage 456 (e.g., VDDCIN). After a delay, the voltage regulator moves from a manual mode to automatic mode by setting VDDCIN_AUTO_SWITCH_MODE=1. The transition from the first power stage 456 to the second power stage 454 may be achieved in an automatic mode in which the current-saturation detection circuitry 465 manages, through the signal provided, the transition from the first power source, VDDCIN, to the second power source, VBAT. Once the current-saturation detection circuitry 465 detects that the first power stage 456 is out of saturation or out of the saturation range, the voltage regulator switches from the first power stage 456 to the second power stage 454. In addition, output signal vddcin_sat_ok is also sent to digital. After a delay, the digital is changed from automatic mode to register control mode through VDDCIN_AUTO_SWITCH_MODE=0.

Similar to FIG. 4A, the control logic circuitry 551 includes output stage control logic 553. In various embodiments, the control logic circuitry 551 operates in both the manual mode and the automatic mode. The latch of the output stage control logic 553 is set to detect the transition from VDDCIN to VBAT only. The transition from VBAT to VDDCIN is set by a register control via VDDCIN_OUTPUT_STAGE_CTRL signal. The D latch input is connected to VDDCIN_OUTPUT_STAGE_CTRL and VDDCIN_AUTO_SWITCH_MODE_rising edge is detected.

Although the embodiments of FIGS. 2-5 illustrate the power stages as being separate, embodiments are not so limited. For example, as illustrated by FIG. 1, the power stages may have overlap, such as shared FET circuitry which is used in both stages. Additionally, although input voltage (e.g., the voltage monitor circuit) and/or saturation monitoring (e.g., the current-saturation sense circuit and current-saturation detection circuitry) is illustrated for only the first power stage, embodiments may additional include input voltage and/or saturation monitoring for the second power stage coupled to the second input port (e.g., VBAT) and/or for both the first and second power stages. In such embodiments, the on-the-fly switching may be from the second conversion stage to the first power stage, and from the first power stage to the second power stage. For example, both input ports may be coupled to external power supply rails.

The above described apparatus may be used to implement a variety of methods. An example method involves power amplification circuitry having a first input port, a second input port, and FET circuitry. The method includes operating the FET circuitry in a saturation mode while drawing power provided at the first input port from a first power source, and sensing, via current-level switch circuitry coupled to the FET circuitry, a change in a current-level used to maintain the FET circuitry in the saturation mode. The method further includes, in response, causing the power amplifier circuitry to draw power provided at the second input port from a second power source while maintaining the saturation mode of the FET circuitry. Maintaining the saturation mode of the FET circuitry may include switching to a different power stage that provides power from the second power source such that the regulated output voltage level of the regulator is maintained.

In various embodiments, the method further including causing the power amplification circuitry to switch on-the-fly by switching from drawing power from the first input port to drawing power from the second input port. For example, wherein during operation, in response to the current-level switch circuitry indicating the change in the current-level, the method includes drawing, via the power amplifier circuitry, power from the second power source, such as a battery, via the second input port.

In a number of related and specific embodiments, the method further includes providing gate control to the FET circuitry via a first power stage and a second power stage of the power amplification circuitry, wherein the first power stage is coupled to the first input port, and the second power stage is coupled to the second input port. The method further includes providing, via an error amplifier, an error-correction signal to the first power stage and the second power stage based on an output signal from the FET circuitry and a reference voltage. The FET circuitry may maintain the saturation mode by switching to the second power stage in response to a decrease in an input source voltage from the first power source (and which causes the first power stage to be at the limit of saturation). Due to the switching, the decrease in the input source voltage from the first power source does not cause a change (e.g., a reduction) in the regulated output voltage of the power amplification circuitry which is used as a power supply for the load circuitry, such as NFC circuitry and/or a secure memory element.

Embodiments as described above are directed to apparatuses and/or IC that include a dual input voltage regulator that may switch between the input power sources. The voltage regulator may switch, for example, on-the-fly, such as from a VDDCIN external power rail supply to a VBAT internal battery supply. The switch between the power sources may minimize transient impact on the output voltage during the switching phase, thereby allowing the load circuity that is supplied by the output voltage to continue operation with minimum or no impact.

In specific embodiments, the voltage regulator includes two different power stages, each associated or coupled to a respective power source, such as VBAT and VDDCIN. The power stages may share the same error amplifier and/or compensation network for providing stability for the stages. The apparatus and/or IC may detect when the power stage is out of saturation and/or at the limit of saturation and switch on-the-fly between the power sources automatically or by register control from VDDCIN to VBAT. The output port may be coupled to an external capacitor which is used as a current tank during the transition to supply the digital and used as a filter to reduce the impact of spikes during the transition. The apparatus may be used in a variety of applications including but not limited to power management, linear regulators, LDO regulators, battery applications, mobile applications, smartwatch applications, linear regulator intellectual property (IP) or modules. In specific embodiments, with rising or falling input voltage from one of the two input supplies, the regulated output voltage remains the same or constant without severe transient voltage.

Terms to exemplify orientation, such as upper/lower, left/right, top/bottom and above/below, may be used herein to refer to relative positions of elements as shown in the figures. It should be understood that the terminology is used for notational convenience only and that in actual use the disclosed structures may be oriented different from the orientation shown in the figures. Thus, the terms should not be construed in a limiting manner.

The skilled artisan would recognize that various terminology as used in the Specification (including claims) connote a plain meaning in the art unless otherwise indicated. As examples, the Specification describes and/or illustrates aspects useful for implementing the claimed disclosure by way of various circuits or circuitry which may be illustrated as or using terms such as blocks, modules, device, system, unit, controller, and/or other circuit-type depictions (e.g., reference numerals 110 and 228 of FIGS. 1 and 2 depict a block/module as described herein). Such circuits or circuitry are used together with other elements to exemplify how certain embodiments may be carried out in the form or structures, steps, functions, operations, activities, etc. For example, in certain of the above-discussed embodiments, one or more modules are discrete logic circuits or programmable logic circuits configured and arranged for implementing these operations/activities, as may be carried out in the approaches descried herein. In certain embodiments, such a programmable circuit is one or more computer circuits, including memory circuitry for storing and accessing a program to be executed as a set (or sets) of instructions (and/or to be used as configuration data to define how the programmable circuit is to perform), and an algorithm or process as described herein is used by the programmable circuit to perform the related steps, functions, operations, activities, etc. Depending on the application, the instructions (and/or configuration data) can be configured for implementation in logic circuitry, with the instructions (whether characterized in the form of object code, firmware or software) stored in and accessible from a memory (circuit).

Based upon the above discussion and illustrations, those skilled in the art will readily recognize that various modifications and changes may be made to the various embodiments without strictly following the exemplary embodiments and applications illustrated and described herein. For example, methods as exemplified in the Figures may involve steps carried out in various orders, with one or more aspects of the embodiments herein retained, or may involve fewer or more steps. For instance, the method described above may be implemented by any of the apparatuses illustrated by FIGS. 1-5. As another example, current-level switch circuitry illustrated by FIG. 4B may be implemented in the apparatuses illustrated by FIG. 1. As a further example, the AC and DC loops illustrated by FIG. 3 may be implemented in the circuitry illustrated by FIGS. 1, 4A-C and 5. Such modifications do not depart from the true spirit and scope of various aspects of the disclosure, including aspects set forth in the claims.

The invention claimed is:

1. A dual input, low drop-out voltage regulator for providing a regulated voltage at an output port, the voltage regulator comprising:

power amplification circuitry having a first input port coupled to a first power source and a first power stage coupled to the first input port, a second input port coupled to a second power source and a second power stage coupled to the second input port, wherein an output of the first power stage and an output of the second power stage are coupled to the output port, wherein the first power stage has at least a first intermediate power stage and a first power field-effect transistor (FET), and the second power stage has at least a second intermediate power stage and a second power FET, wherein at least the first power stage and the second power stage form FET circuitry to operate in a saturation mode while drawing power provided at the first input port from a first power source; and current-level switch circuitry to sense a change in a current-level used to maintain the FET circuitry in the saturation mode, wherein the sensed change in the current level is indicative of the first power FET being out of saturation or at a threshold of being out of saturation, wherein in response to the sensed change in the current-level, the FET circuitry maintains the saturation mode by switching from the first power stage coupled to the first input port to the second power stage coupled to the second input port, and further by, in response to the switch, the second power stage drawing power provided at the second input port from a second power source and the second power FET transitioning to saturation, the FET circuitry maintaining the saturation mode.

2. The voltage regulator of claim 1, wherein when the FET circuitry operates in the saturation mode when a decrease in an input source voltage to the FET circuitry does not cause a change in the regulated output voltage of the power amplification circuitry.

3. The voltage regulator of claim 1, wherein the first intermediate stage provides gate control to the first power FET and the second intermediate stage provides gate control to the second power FET, and wherein the first and the second intermediate stages are each adapted to be controlled by a first signal input coupled to an output of the control logic circuitry and the error correction signal output from the error amplifier.

4. The voltage regulator of claim 1, further including a secure memory element including a circuit to store sensitive data, the secure memory element to operate based on a supply voltage connected to, and with integrity of the stored sensitive data being reliant on, a regulated output voltage provided at the output port, the regulated output voltage to track with the saturation mode of the FET circuitry being maintained.

5. The voltage regulator of claim 1, wherein during operation, in response to the current-level switch circuitry indicating the sensed change in the current-level, the power amplification circuitry switches on-the-fly from drawing power from the first input port to drawing power from the second input port.

6. The voltage regulator of claim 1, wherein during operation, in response to the current-level switch circuitry indicating the sensed change in the current-level, the power amplification circuitry is to switch from drawing power from the first input port to drawing power from the second input port, to minimize transient impact on the regulated output voltage level.

7. The voltage regulator of claim 1, further including a near-field communications circuit to operate based on a regulated output voltage provided in response to an output from the power amplification circuitry, and wherein during operation, in response to the current-level switch circuitry indicating the sensed change in the current-level, the power amplification circuitry is to switch on-the-fly from drawing power from the first input port to drawing power from a battery via the second input port without interfering in communications involving the near-field communications circuit.

8. The voltage regulator of claim 1, further comprising a feedback path to provide an error-correction signal and an error amplifier to provide the error-correction signal to the first power stage and the second power stage based on the output from the first and second power stages and a reference voltage, and wherein, during operation, the feedback path is used irrespective of whether the power amplification circuitry draws power from the first input port or the second input port.

9. The voltage regulator of claim 1, further including a feedback path to provide a feedback signal along a direction from the regulated output voltage signal to another input port of the power amplifier circuitry and wherein, during operation, the feedback path is used irrespective of whether the power amplifier circuitry draws power from the first input port or the second input port.

10. The voltage regulator of claim 1, further including control logic circuitry and a mode register, the control logic circuitry to configure the mode register with data to select whether during operation, the power amplifier circuitry draws power from the first input port or from the second input port.

11. The voltage regulator of claim 1, further including a capacitor connected to the output port, wherein the capacitor is to lessen magnitude of power spikes at the output port.

12. The voltage regulator of claim 1, wherein in response to the sensed change in the current-level, the power amplification circuitry is to draw power from both the second input port and the first input port.

13. A voltage-regulation method involving a dual input low drop out voltage regulator providing a regulated voltage at an output port, wherein the voltage regulator comprises power amplification circuitry having a first input port coupled to a first power source and a first power stage coupled to the first input port, a second input port coupled to a second power source and a second power stage coupled to the second input port, wherein an output of the first power stage and an output of the second power stage are coupled to the output port, wherein the first power stage has at least a first intermediate power stage and a first power field-effect transistor (FET), and a second power stage has at least a second intermediate power stage and a second power FET, wherein at least the first power stage and the second power stage form FET circuitry, the method comprising:

operating the FET circuitry in a saturation mode while drawing power provided at the first input port from a first power source; and sensing, via current-level switch circuitry coupled to the FET circuitry, a change in a current-level, wherein the sensed change in the current level is indicative of the first power FET being out of saturation or at a threshold of saturation used to maintain the FET circuitry in the saturation mode; and in response to a sensed change in the current level, maintaining the saturation mode using the FET circuit by: switching from the first power stage coupled to the first input port to the second power stage coupled to the second input port, and further by; in response to the switch, the second power stage drawing power provided at the second port from the second power source and the source power FET transitioning to saturation, the FET circuitry maintaining the saturation mode.

14. The method of claim 13, further including causing the power amplification circuitry to switch on-the-fly by switching from drawing power from the first input port to drawing power from the second input port.

15. The method of claim 13, wherein during operation, in response to the current-level switch circuitry indicating the change in the current-level, drawing, via the power amplifier circuitry, power from a battery via the second input port.

16. The method of claim 13, further including:

providing gate control to the FET circuitry via a first power stage and a second power stage of the power amplification circuitry, wherein the first power stage is coupled to the first input port, and the second power stage is coupled to the second input port; and providing, via an error amplifier, an error-correction signal to the first power stage and the second power stage based on an output signal from the FET circuitry and a reference voltage.

17. The method of claim 16, wherein causing the power amplifier circuitry to draw power provided at the second input port from the second power source includes switching to the second power stage in response to a decrease in an input source voltage from the first power source such that the decrease in the input source voltage does not cause a reduction in a regulated output voltage provided by the power amplification circuitry.

* * * * *